US009486042B2

(12) United States Patent
Isaacs et al.

(10) Patent No.: US 9,486,042 B2
(45) Date of Patent: Nov. 8, 2016

(54) WRISTBAND WITH RECESSED CLASP AND METHOD OF ASSEMBLING AND OPERATING SAME

(71) Applicant: Google Technology Holdings LLC, Mountain View, CA (US)

(72) Inventors: Dickon Isaacs, Chicago, IL (US); Daniel T. Berg, Gilroy, IL (US); Michael F. Paradise, Chicago, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 100 days.

(21) Appl. No.: 14/446,359

(22) Filed: Jul. 30, 2014

(65) Prior Publication Data

US 2015/0351503 A1 Dec. 10, 2015

Related U.S. Application Data

(60) Provisional application No. 62/008,147, filed on Jun. 5, 2014.

(51) Int. Cl.
*A44C 5/24* (2006.01)
*A44C 5/02* (2006.01)

(52) U.S. Cl.
CPC . *A44C 5/24* (2013.01); *A44C 5/02* (2013.01); *Y10T 24/2155* (2015.01)

(58) Field of Classification Search
CPC ..... A44C 5/24; A44C 5/02; Y10T 24/2155
USPC .... 63/3.1, 7, 9, 10; 24/71 J, 265 WS; 59/80, 59/82; 368/282
See application file for complete search history.

(56) References Cited

U.S. PATENT DOCUMENTS

| | | | | |
|---|---|---|---|---|
| 2,532,840 | A * | 12/1950 | Gaun | A44C 5/24 24/71 J |
| 5,579,559 | A * | 12/1996 | Ferrario | A44C 5/24 24/265 WS |
| 6,094,782 | A * | 8/2000 | Gay | A44C 5/24 24/68 J |
| 6,401,307 | B1 * | 6/2002 | Wild | A44C 5/24 24/265 WS |
| 6,434,798 | B1 * | 8/2002 | Yamakawa | A44C 5/24 24/265 WS |
| 6,449,809 | B2 * | 9/2002 | Thalheim | A44C 5/24 24/71 J |
| 6,792,652 | B2 * | 9/2004 | Ferrario | A44C 5/24 24/265 WS |
| 7,107,790 | B2 * | 9/2006 | Frank | A44C 5/14 224/164 |
| 8,665,085 | B2 * | 3/2014 | Hyatt | G08B 21/0269 24/265 WS |
| 2005/0193767 | A1 * | 9/2005 | Frank | A44C 5/14 63/9 |

OTHER PUBLICATIONS

Watch Back Openers for Any Watch, Watch Clasps, Watch Buckles and Watch Extenders, http://www.esslinger.com/watchclaspswatchbucklesandwatchextenders.aspx, downloaded from the Internet Apr. 4, 2014, all pages.

* cited by examiner

*Primary Examiner* — Abigail Morrell
(74) *Attorney, Agent, or Firm* — Faegre Baker Daniels LLP

(57) ABSTRACT

A wristband has a clasp that includes a clasp latch and a clasp leg having an inner end and an outer end, wherein the inner end of the clasp leg is pivotally connected to a first end of the clasp latch. The wristband also includes a set of links having an end pivotally connected to the outer end of the clasp leg, wherein an inside face of at least one link of the set of links is recessed to form a recession that is shaped to cradle the clasp leg and at least a portion of the clasp latch when the clasp is closed.

19 Claims, 12 Drawing Sheets

WRISTBAND WITH RECESSED CLASP AND METHOD OF ASSEMBLING AND OPERATING SAME

RELATED APPLICATION

The present application is related to and claims benefit under 35 U.S.C. §119(e) of the following U.S. Provisional Patent Application Ser. No. 62/008,147, filed Jun. 5, 2014, titled "Wristband with Recessed Clasp and Method for Assembling and Operating Same" which is commonly owned with this application by Motorola Mobility, Inc., and the entire contents of which is incorporated herein by reference.

FIELD OF THE DISCLOSURE

The present disclosure relates generally to a wristband and more particularly to a wristband having a recessed clasp.

BACKGROUND

Many wristbands having links also have clasps that remain visible when the wristbands are worn. Whether a wristband is worn as jewelry or used to carry a watch or other portable device, a clasp that remains visible when the wristband is worn can detract from the esthetics of the wristband. Other wristbands have protruding clasps that can be felt against the wrist when the wristbands are worn. A clasp that protrudes from a wristband and is felt against the wrist can make the wristband uncomfortable to wear.

BRIEF DESCRIPTION OF THE FIGURES

The accompanying figures, where like reference numerals refer to identical or functionally similar elements throughout the separate views, form part of the specification and illustrate embodiments in accordance with the claims.

Figure 1:
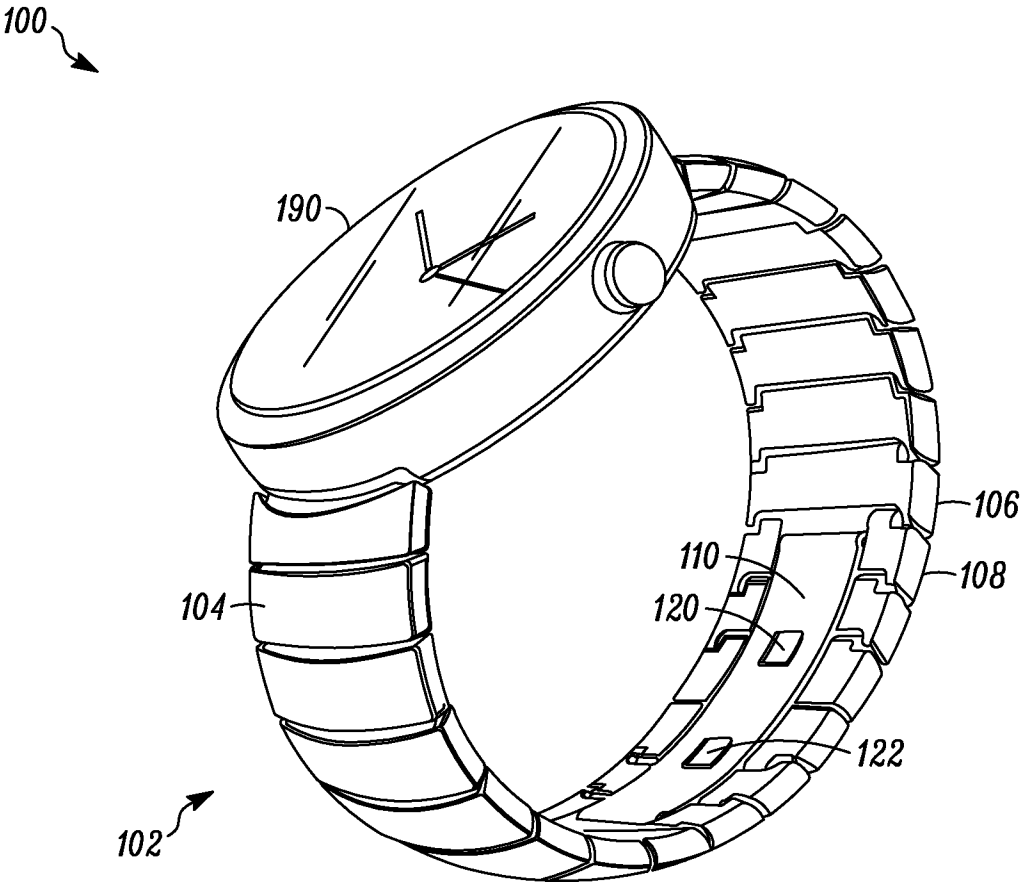
FIG. 1 shows a perspective view of a wristwatch having a wristband with a recessed clasp in accordance with an embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present teachings. In addition, the description and drawings do not necessarily require the order presented. It will be further appreciated that certain actions and/or steps may be described or depicted in a particular order of occurrence while those skilled in the art will understand that such specificity with respect to sequence is not actually required.

The apparatus and method components have been represented, where appropriate, by conventional symbols in the drawings, showing only those specific details that are pertinent to understanding the embodiments of the present teachings so as not to obscure the disclosure with details that will be readily apparent to those of ordinary skill in the art having the benefit of the description herein.

DETAILED DESCRIPTION

Generally speaking, pursuant to various embodiments described herein, the present disclosure describes a wristband, and methods for assembling and operating the wristband, with a recessed clasp which folds into a recession of the wristband and is hidden from view when the clasp is closed. In accordance with the teachings herein, a wristband has a clasp that includes a clasp latch having a first end and a second end. The clasp also includes a first clasp leg having an inner end and an outer end, wherein the inner end of the first clasp leg is pivotally connected to the first end of the clasp latch. The clasp further includes a second clasp leg having an inner end and an outer end, wherein the inner end of the second clasp leg is pivotally connected to the second end of the clasp latch. The wristband also includes a first set of links having an inner end pivotally connected to the outer end of the first clasp leg, wherein an inside face of at least one link of the first set of links is recessed to form a first recession that is shaped to cradle the first clasp leg and a first part of the clasp latch when the clasp is closed. The wristband further includes a second set of links having an inner end pivotally connected to the outer end of the second clasp leg, wherein an inside face of at least one link of the second set of links is recessed to form a second recession that is shaped to cradle the second clasp leg and a second part of the clasp latch when the clasp is closed.

Also in accordance with the teachings herein is a wristband with a clasp latch having a first end and a second end and also a clasp leg having an inner end and an outer end, wherein the inner end of the clasp leg is pivotally connected to the first end of the clasp latch. The wristband additionally includes a first set of links having an inner pivotally connected to the outer end of the clasp leg, and wherein an inside face of at least one link of the first set of links is recessed to form a recession that is shaped to cradle the clasp leg and the clasp latch when the clasp is closed. The wristband further includes a second set of links having an inner end pivotally connected to the second end of the clasp latch. For one embodiment, the wristband also includes a portable electronic device connected between an outer end of the first set of links and an outer end of the second set of links.

Additionally in accordance with the teachings herein is a method for operating a wristband with a recessed clasp that includes rotating a first clasp leg about a first pivotal connection between the first clasp leg and a first set of links and rotating a first part of a clasp latch about a second pivotal connection between the first part of the clasp latch and the first clasp leg until the first part of the clasp latch and the first clasp leg are folded into a first recession formed in an inside face of at least one link of the first set of links. The method additionally includes rotating a second clasp leg about a third pivotal connection between the second clasp leg and a second set of links and rotating a second part of the clasp latch about a fourth pivotal connection between the second part of the clasp latch and the second clasp leg until the second part of the clasp latch and the second clasp leg are folded into a second recession formed in an inside face of at least one link of the second set of links.

Further in accordance with the teachings herein is a method of assembling an apparatus having a wristband with a recessed clasp that includes pivotally connecting a first end of a clasp latch to an inner end of a first clasp leg and pivotally connecting a second end of the clasp latch to an inner end of a second clasp leg. The method also includes pivotally connecting an outer end of the first clasp leg to an inner end of a first set of links having at least one link with an inside face that is recessed to form a first recession that is shaped to cradle the first clasp leg and a first part of the clasp latch when the clasp is closed. The method additionally includes pivotally connecting an outer end of the second clasp leg to an inner end of a second set of links having at least one link with an inside face that is recessed to form a second recession that is shaped to cradle the second clasp leg and a second part of the clasp latch when the clasp is closed.

Referring now to the drawings and in accordance with an embodiment, FIG. 1 shows a wristwatch 100 having a wristband 102 with a clasp that recesses into the wristband 102 when the clasp is closed. In the illustrated embodiment, the wristband 102 is formed using individual links, such as a link 104 and a link 106. In describing the wristband 102 and its clasp, inside faces are directed toward a wrist passing through the wristband 102 when the wristband 102 is clasped about the wrist. Outside faces are directed away from the wrist upon which the wristband 102 is worn. Given the perspective of FIG. 1, an outside face of link 104 and an inside face of link 106 are visible.

Unlike the link 106, an inside face of a link 108 is recessed. In a closed configuration, the clasp of the wristband 102 fits into a recession formed by the recession in the inside face of link 108 and recessions of other recessed links. Visible on an inside face of the clasp latch 110, is a backside of a protrusion 120 and a backside of a protrusion 122. The protrusions 120 and 122 protrude from an outside face of the clasp latch and fit into depressions within clasp legs to fasten the clasp latch 110 into the recessed links. A watch 190 is connected to outer ends of the wristband 102 to form the wristwatch 100. In other embodiments, the outer ends of the wristband 102 are connected to different portable electronic devices, such as a portable computing device, a smartwatch, a music player, a monitoring device for pulse rate and/or blood pressure, a personal navigation device, or other such devices.

Figure 2:
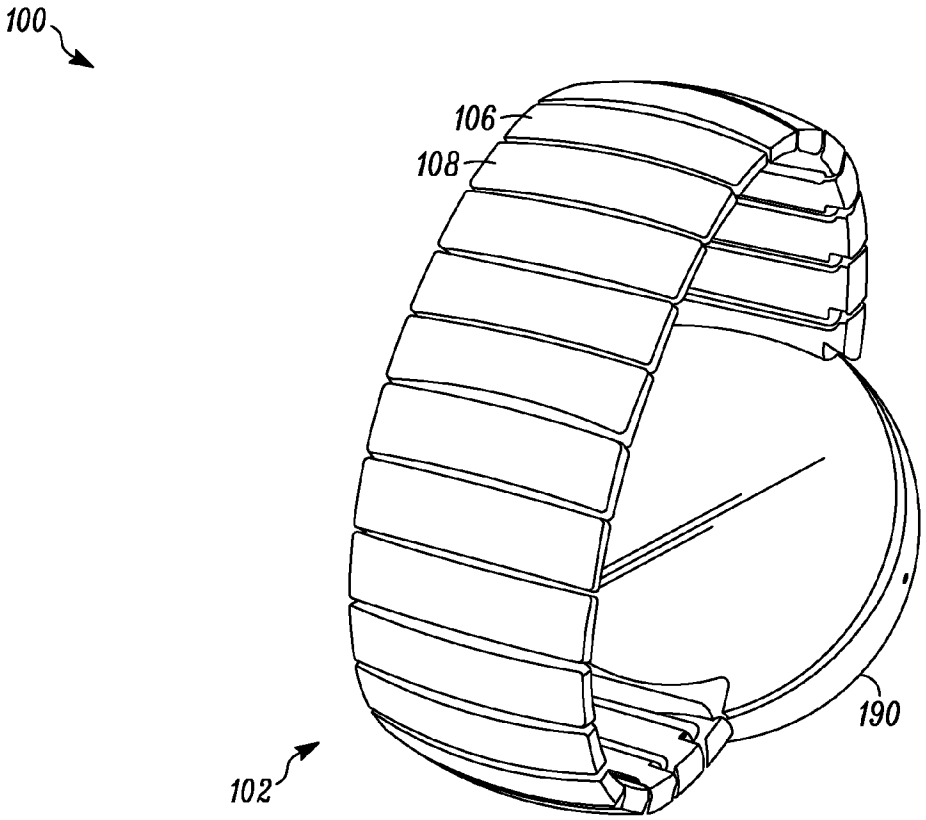
FIG. 2 shows a perspective view of a wristwatch having a wristband with a recessed clasp in accordance with an embodiment.

FIG. 2 shows the wristwatch 100 as viewed from underneath with an inside face of the watch 190 and outside faces of the links 106 and 108 visible. As viewed from the outside, the clasp in not visible, and the links that form the wristband 102 appear contiguous along an entire length of the wristband 102. The recessed clasp on the inside of the wristband 102 is only visible when the wristband 102 is not being worn. While the wristband 102 is being worn about a wrist, the wrist can obstruct any view of the clasp from any vantage point.

Figure 4:
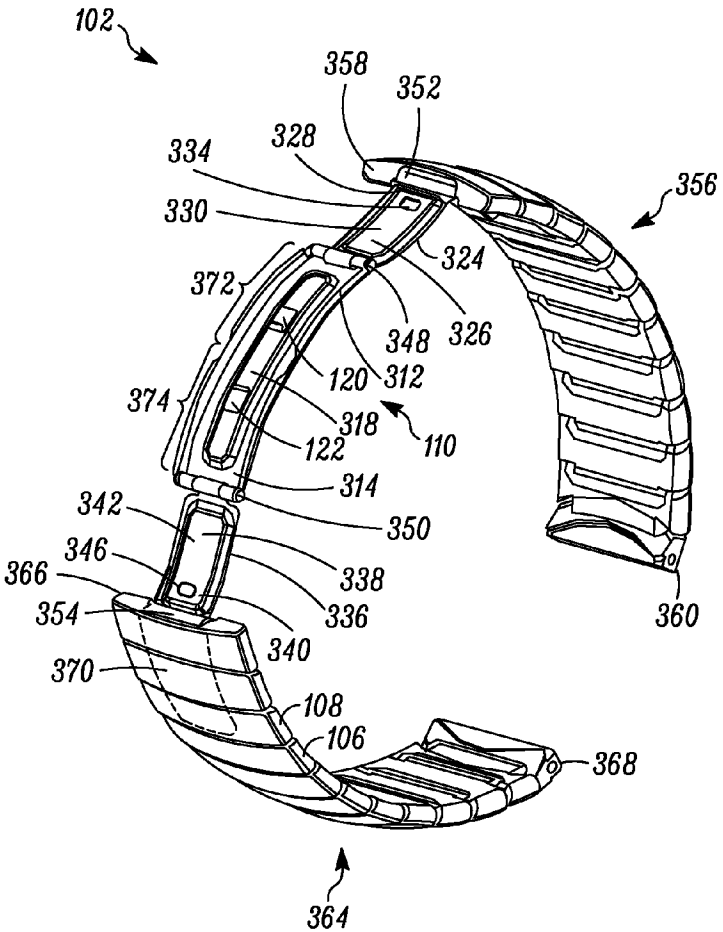
FIG. 4 shows a perspective view of a wristband with an open clasp in accordance with an embodiment.
Figure 3:
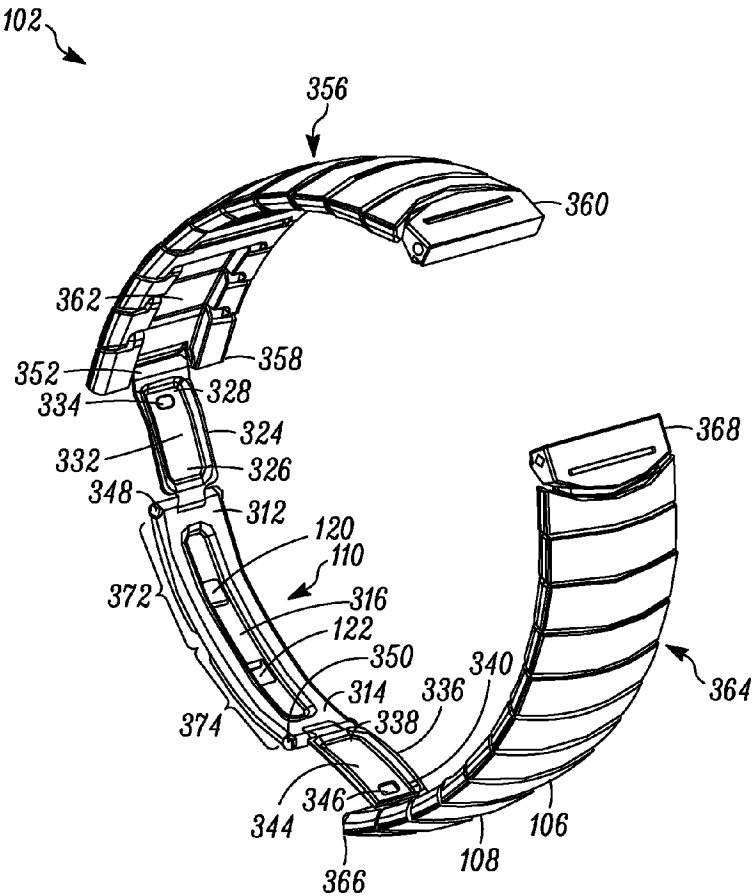
FIG. 3 shows a perspective view of a wristband with an open clasp in accordance with an embodiment.

FIGS. 3 and 4 show the wristband 102 with its clasp open from two different perspectives to illustrate various components and features of the wristband 102 used to describe enclosed embodiments. In particular, FIGS. 3 and 4 show a clasp latch 110, a first clasp leg 324, a second clasp leg 336, a first set of links 356, a second set of links 364, and four pivotal connections 348, 350, 352, 354.

The clasp latch 110 and the first 324 and second 336 clasp legs form the clasp of the wristband 102. The clasp latch 110 has a first end 312 and a second end 314, and also an inside face 316 and an outside face 318. The clasp latch 110 also has a first part 372 and a second part 374. The first part 372 of the clasp latch 110 includes a half of the clasp latch 110 that includes the first end 312 and excludes the second end 314 of the clasp latch 110. The second part 374 of the clasp latch 110 includes a half of the clasp latch 110 that includes the second end 314 and excludes the first end 312 of the clasp latch 110. The first clasp leg 324 has an inner end 326 and an outer end 328, and also an inside face 330 and an outside face 332, which are directed toward the inside and the outside, respectively, of the wristband 102 when the clasp is closed. Similarly, the second clasp leg 336 has an inner end 338 and an outer end 340, and also an inside face 342 and an outside face 344.

The first end 312 of the clasp latch 110 is pivotally connected to the inner end 326 of the first clasp leg 324 by the pivotal connection 348, allowing the first end 312 of the clasp latch 110 to rotate freely about the inner end 326 of the first clasp leg 324. For the embodiment shown, when first end 312 of the clasp latch 110 is rotated about the pivotal connection 348 so that the outside face 318 of the first part 372 of the clasp latch 110 meets with the inside face 330 of the first clasp leg 324, the protrusion 120 on the outside face 318 of the clasp latch 110 aligns with an indent 334 on the inside face 330 of the first clasp leg 324. This allows the first part 372 of the clasp latch 110 and the first clasp leg 324 to be "snapped" together, thereby fastening the clasp latch 110 to the first clasp leg 324 when the clasp is closed.

The second end 314 of the clasp latch 110 is pivotally connected to the inner end 338 of the second clasp leg 336 by the pivotal connection 350, allowing the second end 314 of the clasp latch 110 to rotate freely about the inner end 338 of the second clasp leg 336. When second end 314 of the clasp latch 110 is rotated about the pivotal connection 350 so that the outside face 318 of the second part 374 of the clasp latch 110 meets with the inside face 342 of the second clasp leg 336, the protrusion 122 on the outside face 318 of the clasp latch 110 aligns with an indent 346 on the inside face 342 of the second clasp leg 336. This allows the second part 374 of the clasp latch 110 and the second clasp leg 336 to be snapped together when the clasp is closed.

The first set of links 356 includes links that have their inside faces recessed to form a first recession 362 that cradles the first clasp leg 324 and the first part 372 of the clasp latch 110 when the clasp is closed. The outer end 328 of the first clasp leg 324 is pivotally connected to an inner end 358 of the first set of links 356 by the pivotal connection 352. The pivotal connection 352 allows the first clasp leg 324 to rotate into the first recession 362, and the pivotal connection 348 allows the first part 372 of the clasp latch 110 to be folded over the first clasp leg 324 into the first recession 362.

The second set of links 364 also includes links having recessed inside faces. The recessions on the inside faces of adjacent links combine to form a second recession 370 that cradles the second clasp leg 336 and the second part 374 of the clasp latch 110 when the clasp is closed. The outer end 340 of the second clasp leg 336 is pivotally connected to an inner end 366 of the second set of links 364 by the pivotal connection 354. The pivotal connection 354 allows the second clasp leg 336 to rotate into the second recession 370, and the pivotal connection 350 allows the second part 374 of the clasp latch 110 to be folded over the second clasp leg 336 into the second recession 370. Links 106 and 108 of the second set of links 364 are labeled to provide an orientation for comparing the various views of the wristband 102 provided by FIGS. 1, 2, 3, 4, 7, 8, 9, 10, 11, 12, 13, 15, and 16 of the present disclosure.

The pivotal connections 348, 350, 352, and 354 include a mechanism by which components attached to the pivotal connections 348, 350, 352, 354 can rotate relative to one another. In one embodiment, for example, the pivotal connections 348, 350, 352, 354 include cylindrical pins to allow rotation. For another embodiment, the pivotal connections 348, 350, 352, 354 include ball or roller bearings to allow rotation.

At an outside end 360 of the first set of links 356 and an outside end 368 of the second set of links 364 are attachment points to which an object can be attached to the wristband 102. Objects attached to the wristband 102 may be functional, such as a watch or an electronic computing device, or may be ornamental, such as when the wristband 102 is worn as jewelry. For a particular embodiment, the links of the wristband 102 are contiguous from the pivot 352 to the pivot 354, and the wristband 102 is worn without an additional object attached.

The individual components of the wristband 102 may be formed or constructed from any material having sufficient rigidity for the components to perform their intended functions as described herein. For particular embodiments, materials used to form components of the wristband 102 include, but are not limited to, metals, woods, minerals, plastics, and resins.

Additional figures show different views of the wristband 102. When describing these different views, reference may be made to reference numbers that appear in FIGS. 3 and 4 but that do not appear in the figure being described. This is done for ease of illustration and to emphasize a particular feature or the functionality of that feature.

Figure 5:
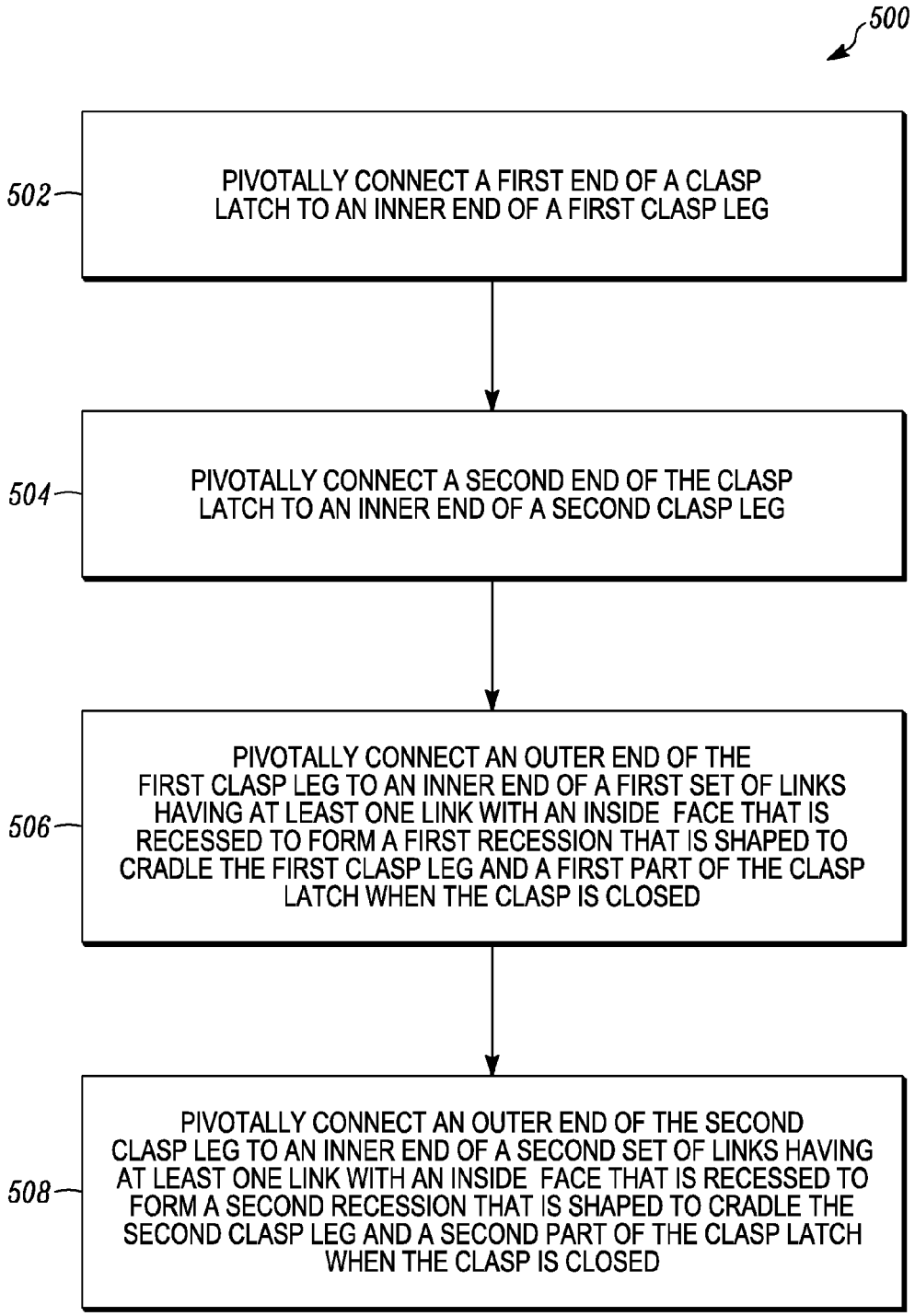
FIG. 5 shows a logical flow diagram illustrating a method of assembling a wristband with a recessed clasp in accordance with an embodiment.

We now turn to a brief description of how the components shown in FIGS. 3 and 4 are combined to form the wristband 102. In accordance with a particular embodiment, FIG. 5 shows a logical flow diagram illustrating a method 500 by which the clasp latch 110, the clasp legs 324, 336, and the two sets of links 356, 364 are assembled into the wristband 102 having a recessed clasp. The method 500 includes pivotally connecting 502 the first end 312 of the clasp latch 110 to the inner end 326 of the first clasp leg 324 and pivotally connecting 504 the second end 314 of the clasp latch 110 to the inner end 338 of the second clasp leg 336.

The method 500 also includes pivotally connecting 506 the outer end 328 of the first clasp leg 324 to the inner end 358 of the first set of links 356. At least one link of the first set of links 356 has its inside face recessed to form the first recession 362. The first recession 362 is shaped to allow it to cradle the first clasp leg 324 and the first part 372 of the clasp latch 110 when the clasp is closed. The method 500 further includes pivotally connecting 508 the outer end 340 of the second clasp leg 336 to the inner end 366 of the second set of links 364. At least one link of the second set of links 364 has its inside face recessed to form the second recession 370. The second recession 370 is shaped to allow it to cradle the second clasp leg 336 and the second part 374 of the clasp latch 110 when the clasp is closed.

Figure 6:
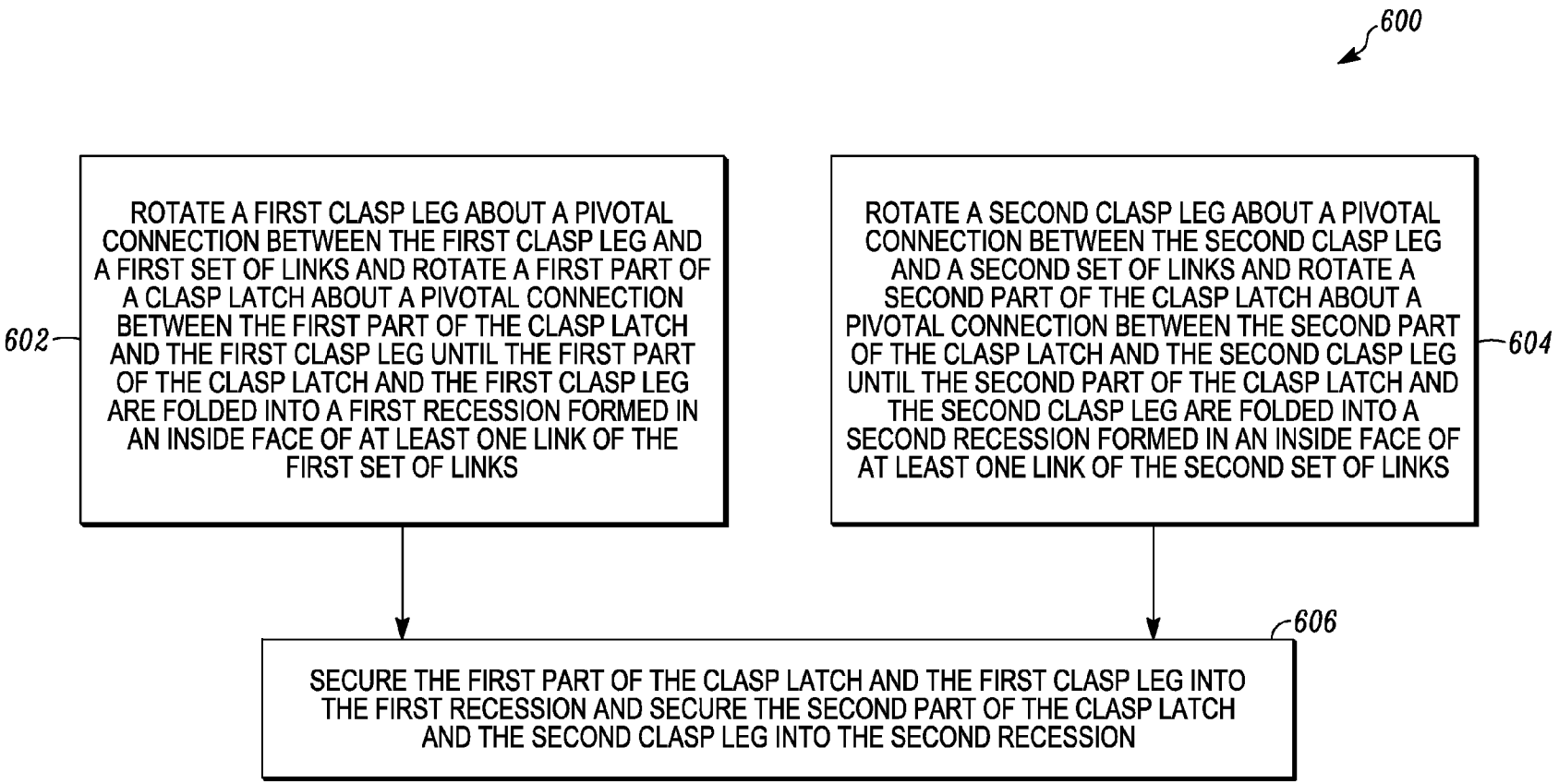
FIG. 6 shows a logical flow diagram illustrating a method of operating a wristband with a recessed clasp in accordance with an embodiment.

Operating the wristband 102 is described with reference to FIGS. 6 and 7. FIG. 6 shows a logical flow diagram illustrating a method 600 for closing the clasp of the wristband 102. The method 600 includes rotating 602 the first clasp leg 324 about the pivotal connection 352 located between the outer end 328 of the first clasp leg 324 and the inner end 358 of the first set of links 356. As the first clasp leg 324 rotates about the pivotal connection 352, the first part 372 of the clasp latch 110 rotates about the pivotal connection 348 between the first part 372 of the clasp latch 110 and the inner end 326 of the first clasp leg 324. The first clasp leg 324 and the clasp latch 110 continue to rotate until the first clasp leg 324 and the first part 372 of the clasp latch 110 are folded into the first recession 362.

The method 600 also includes rotating 604 the second clasp leg 366 about the pivotal connection 354 located between the outer end 340 of the second clasp leg 336 and the inner end 366 of the second set of links 364. As the second clasp leg 336 rotates about the pivotal connection 354, the second part 374 of the clasp latch 110 also rotates about the pivotal connection 350 between the second part 374 of the clasp latch 110 and the inner end 338 of the second clasp leg 336. The second clasp leg 336 and the clasp latch 110 continue to rotate until the second clasp leg 336 and the second part 374 of the clasp latch 110 are folded into the second recession 370.

Although the rotation 602 of the first clasp leg 324 and the rotation 604 of the second clasp leg 336 are shown as occurring in parallel or contemporaneously with one another, the rotation of the first 324 and the second 336 clasp legs may occur sequentially, in parallel, partially in parallel, or without any particular timing relationship. In some embodiments, a geometric relationship among the components of the clasp latch will cause the components to move together or move relative to one another in a particular way when the components are acted upon by one or more forces.

After the clasp legs 324, 336 and the clasp latch 110 are folded into the first 362 and second 370 recessions, the method 600 further includes securing 606 the first part 372 of the clasp latch 110 and the first clasp leg 324 into the first recession 362 and securing 606 the second part 374 of the clasp latch 110 and the second clasp leg 336 into the second recession 370. Securing the clasp legs 324, 336 and the clasp latch 110 within the first 362 and second 370 recessions is described in detail with reference to FIGS. 7, 10, 11, and 12.

Figure 7:
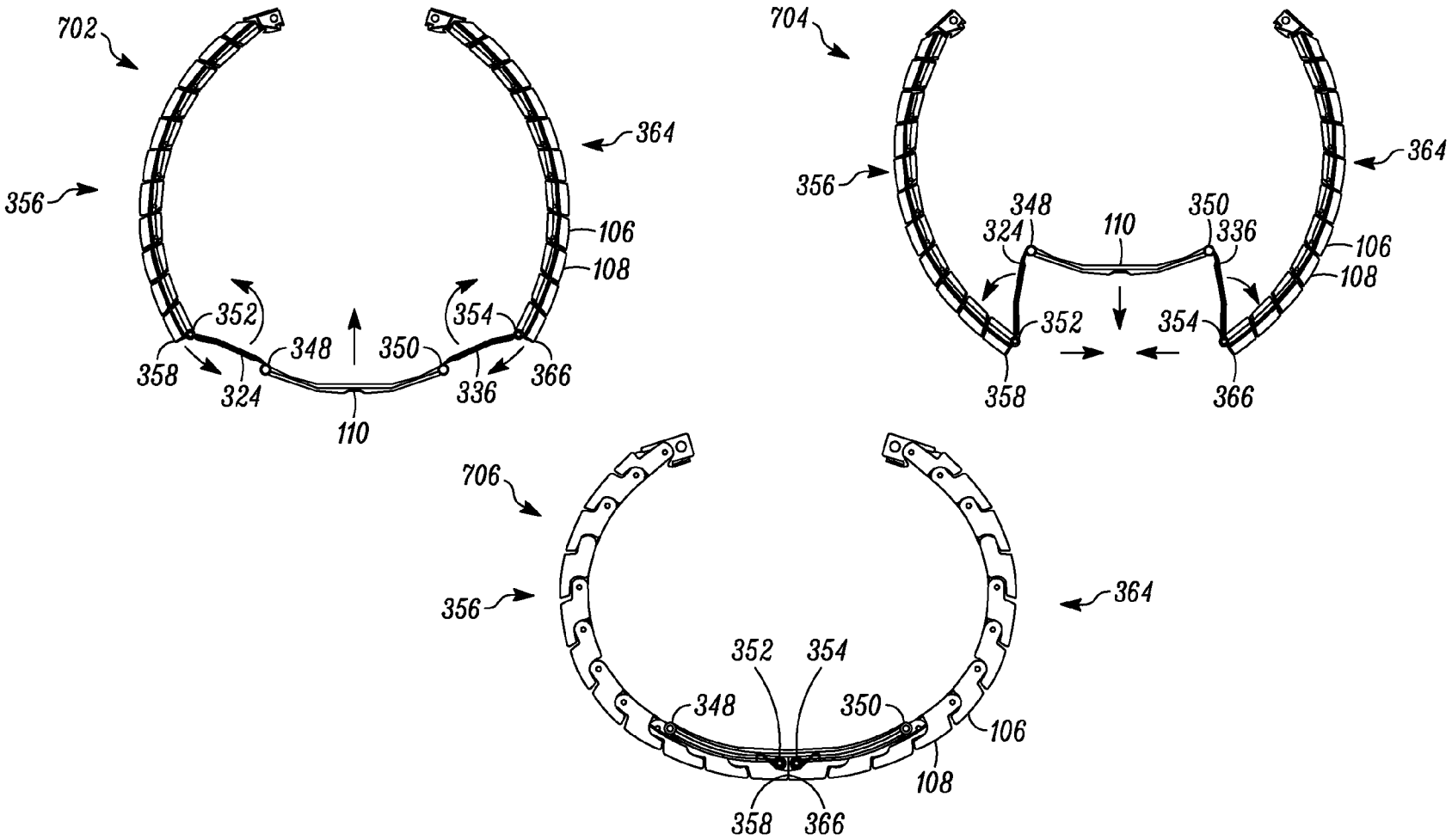
FIG. 7 shows a sequence of side views illustrating the operation of a wristband with a recessed clasp in accordance with an embodiment.

FIG. 7 shows a sequence of views 702, 704, 706 illustrating the movement of the individual components of the wristband 102 indicated in FIGS. 3 and 4 as the clasp is being closed. In the view 702, the clasp of the wristband 102 is fully open. The clasp legs 324, 336 and the clasp latch 110 are all orientated horizontally, resulting in the widest possible space between the inner ends 358, 366 of the first 356 and second 364 set of links. The first leg 324 rotates counterclockwise about the pivotal connection 352, and the second leg 336 rotates clockwise about the pivotal connection 354. As the first 324 and second 336 legs rotate, their inner ends 326, 338, with the clasp latch 110 pivotally connected between them, lift the clasp latch 110 up. As the clasp legs 324, 336 transition toward vertical orientations, the space between the inner ends 358, 366 of the first 356 and second 364 set of links decreases as the ends 358, 366 move toward one another.

In view 704, the clasp latch 110 remains horizontal but rises to its highest position as the clasp legs 324, 336 are rotated into vertical orientations. As the clasp legs 324, 336 continue to rotate past their vertical orientations, the clasp latch 110 begins to drop, and the inner ends 358, 366 of the first 356 and second 364 set of links continue to move toward one another. The outside face 332 of the first clasp leg 324 approaches the inside faces of the recessed links of the first set of links 356 while the outside face 344 of the second clasp leg 336 approaches the inside faces of the recessed links of the second set of links 364. As the inner ends 358, 366 of the two sets of links 356, 364 continue to approach each other, the clasp latch 110 drops over the inside faces 330, 342 of the clasp legs 324, 336.

In view 706, the clasp is closed. The first clasp leg 324 is folded into the first recession 362 underneath the first part 372 of the clasp latch 110, and the second clasp leg 336 is folded into the second recession 370 underneath the second part 374 of the clasp latch 110. The outside face 318 of the clasp latch 110 is against the inside faces 330, 342 of the first 324 and second 336 clasp legs, and the inside face 316 of the clasp latch 110 faces the inside of the wristband 102 toward a wearer's wrist. For an embodiment, the inside face 316 of the clasp latch 110 is flush with or below inside faces of non-recessed links of the first 356 and second 364 set of links when the clasp is closed.

The inside face 316 of the clasp latch 110 being flush with or below inside faces of non-recessed links means that the clasp latch 110 is seated entirely within the recesses 362, 370. No portion of the inside face 316 of the clasp latch 110 protrudes into the inside of the wristband 102 beyond a curved surface formed by the inside faces of un-recessed links and the portions of the inside faces of the recessed links that are not recessed. With no portion of the clasp legs 324, 336 or the clasp latch 110 protruding out of the recesses 362, 370, the clasp latch 110 is entirely recessed within the recesses 362, 370 and hidden from view when the wristband is worn. Further, any discomfort that would otherwise be caused by a protruding portion of the clasp pressing into a wearer's wrist is minimized or eliminated.

With the clasp closed, the components of the clasp, namely, the clasp legs 324, 336 and the clasp latch 110, are secured within the first 362 and second 370 recessions by one or more fastening mechanisms. As used herein, "securing" means to hold in place, and "fastening" means to connect. In one embodiment, a fastening mechanism is configured to secure the first part 372 of the clasp latch 110 within the first recession 362 over the first clasp leg 324 and to secure the second part 374 of the clasp latch 110 within the second recession 370 over the second clasp leg 336, when the clasp is closed. For example, a fastening mechanism includes the first protrusion 120 and the second protrusion 122 formed in the outside face 318 of the clasp latch 110. The fastening mechanism also includes the first depression 334 formed in the inside face 330 of the first clasp leg 324 that mates with the first protrusion 120 when the clasp is closed. The fastening mechanism further includes the second depression 346 formed in the inside face 342 of the second clasp leg 336 that mates with the second protrusion 122 when the clasp is closed. As used herein, "mate" means to join or pair. In this case, a protrusion joins or pairs with a depression that is designed to accommodate the protrusion by being, for example, of comparable size and shape. By applying pressure to the inside face 316 of the clasp latch 110, a wearer can cause the protrusions 120 and 122 to snap into the depressions 334 and 346, respectively, thereby fastening the clasp latch 110 to the first 324 and second 336 clasp legs and securing the clasp latch 110 within the first 363 and second 370 recessions.

In some embodiments, the clasp legs 324, 336 and the clasp latch 110 are formed having curvature to follow a curvature created by the links of the wristband 102 as the wristband is being worn. In a particular embodiment, the inside face 330 of the first clasp leg 324, the inside face 342 of the second clasp leg 336, and the inside face 316 of the clasp latch 110 have concave curvature. The outside face 332 of the first clasp leg 324, the outside face 344 of the second clasp leg 336, and the outside face 318 of the clasp latch 110 are given convex curvature. The amount of curvature given to the clasp legs 324, 336 and the clasp latch 110 "anticipates" the amount of curvature the wristband will have as it is being worn around a wearer's wrist. Further descriptions of the curvature of the clasp legs 324, 336 and the clasp latch 110 are provided with reference to FIGS. 10, 11, and 13.

View 706 shows that for the illustrated embodiment, the clasp latch 110 has a combined length of the first 324 and second 336 clasp legs. If the first 324 and second 336 clasp legs are of equal length, as shown, then the clasp latch 110 is twice the length of either clasp leg. This results in the inner end 358 of first set of links 356 being adjacent to the inner end 366 of second set of links 364 when the clasp is closed. In an alternate embodiment, the clasp latch 110 is longer than the combined length of the first 324 and second 336 clasp legs such that there will still be space between the inner ends 358, 366 of the first 356 and second 364 set of links when the clasp is closed. In this embodiment, a portion of the outside face 318 of the clasp latch 110 is made to resemble one or more links. These "false links" fill the space between the inner ends 358, 366 of the first 356 and second 364 set of links when the clasp is closed and provide the appearance of a contiguous series of links around the outside of the clasp.

Figure 9:
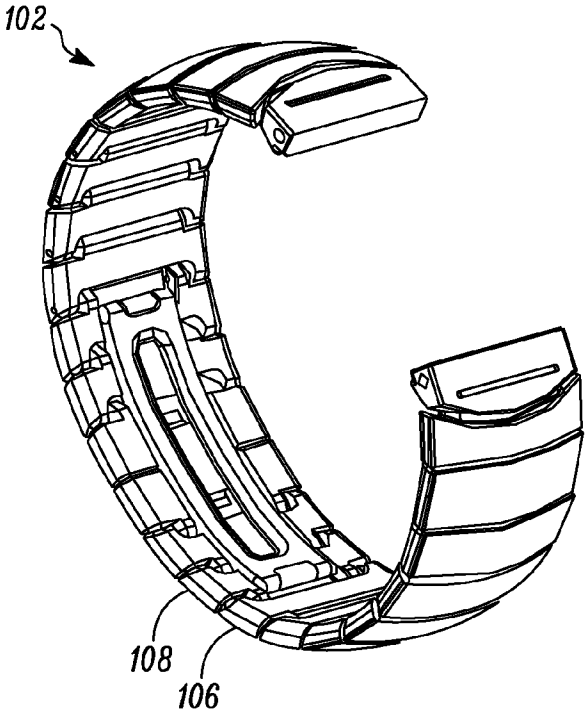
FIG. 9 shows a perspective view of a wristband with a closed clasp in accordance with an embodiment.
Figure 8:
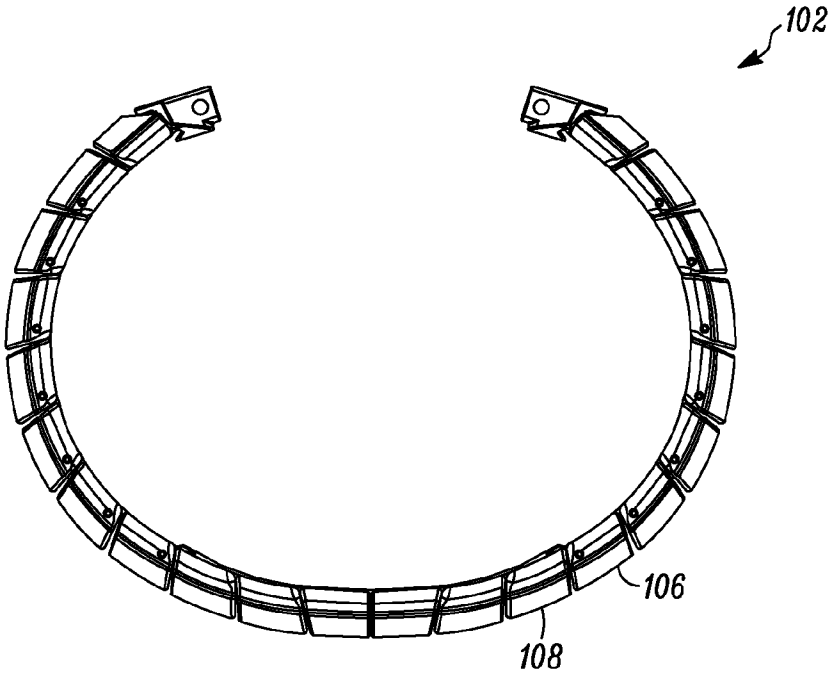
FIG. 8 shows a side view of a wristband with a closed clasp in accordance with an embodiment.

FIG. 8 shows a side view of the wristband 102 with its clasp closed as it would be worn upon a wrist. The links of the wristband 102 are continuous around the clasp. In FIG. 9, a perspective view of the inside wristband 102 illustrates that the clasp latch 110 is fully recessed into the first 362 and second 370 recessions formed by the recessed links of the first 356 and second 364 set of links. The clasp legs 324, 336 and the clasp latch 110 are contoured to follow the curvature of the wristband 102 as the wristband is being worn.

In the embodiment shown, the clasp latch 110 is longer than the individual clasp legs 324 336 and also rigid so that it is unable to conform to a range of curvatures the links of the wristband 102 take on when the wristband 102 is worn on different size wrists. The six links shown under the clasp in FIGS. 8 and 9 are not free to pivot relative to one another when the clasp is closed because the clasp latch 110 is rigid and inflexible. In alternate embodiments, the clasp latch 110 includes a plurality of portions, wherein each portion of the clasp latch 110 is pivotally connected to another portion of the clasp latch 110. One such alternate embodiment is shown in FIGS. 10 and 11.

Figure 11:
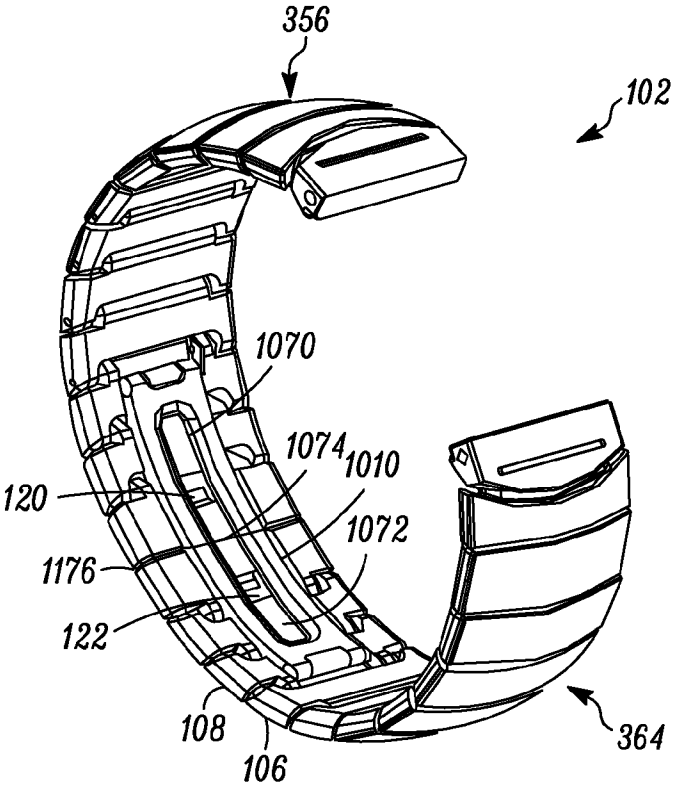
FIG. 11 shows a perspective view of a wristband with a closed clasp having a pivoted clasp latch in accordance with an embodiment.
Figure 10:
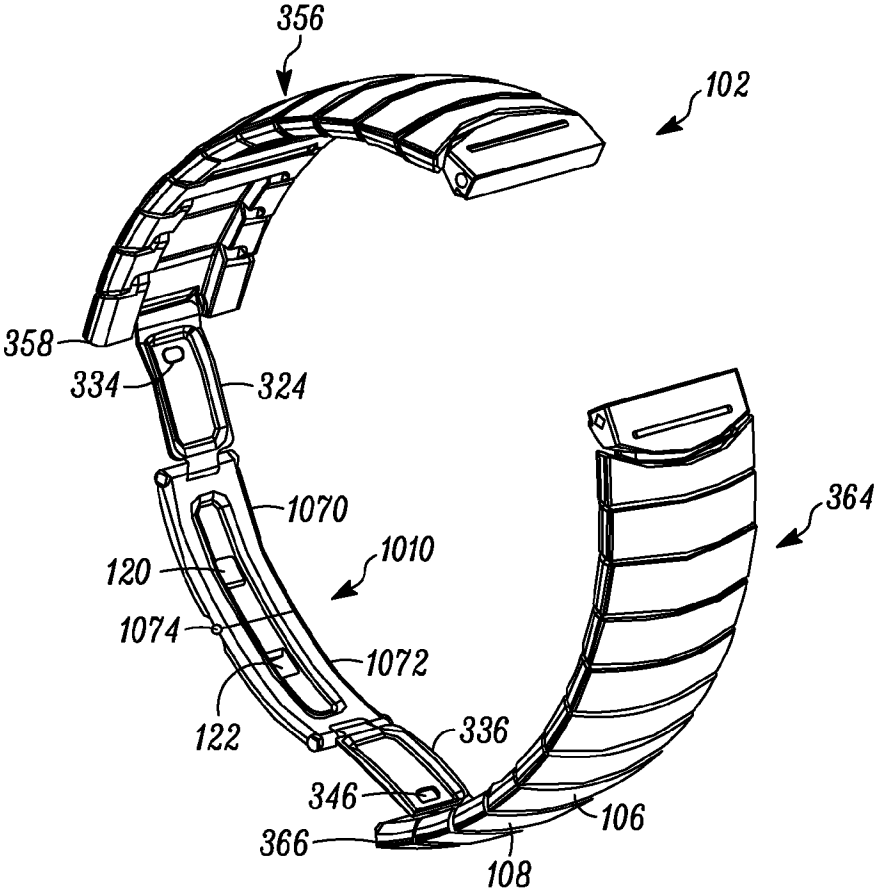
FIG. 10 shows a perspective view of a wristband with an open clasp having a pivoted clasp latch in accordance with an embodiment.

FIG. 10, in which the clasp of the wristband 102 is open, and FIG. 11, in which the clasp is closed, each show an embodiment for which a clasp latch 1010 of the wristband 102 has a first portion 1070 and a second portion 1072 that are pivotally connected to one another by the pivotal connection 1074. When the clasp is closed, the pivotal connection 1074 between the first 1070 and second 1072 portions of the clasp latch 1010 aligns between the inner end 358 of the first set of links 356 and the inner end 366 of the second set of links 364. This allows for additional flexibility in the wristband 102 when the clasp is closed. The center of the clasp latch 1010 is free to pivot as the inner end 358 of the first set of links 356 and the inner end 366 of the second set of links 364 move relative to one another. In this way, the clasp latch 1010 can accommodate a wider range of wrist sizes, and the wristband 102 is more comfortable to wear.

For one embodiment in which the clasp latch 1010 includes multiple portions that are pivotally connected to one another, each portion is individually secured within the first 362 or second 370 recession by a fastening mechanism. The portion 1070, for example, is secured within the first recession 362 by fastening the first portion 1070 to the first clasp leg 324. This is done by snapping the protrusion 120 into the depression 334. The portion 1072 is secured within the second recession 370 by fastening the portion 1072 to the second clasp leg 336. This is done by snapping the protrusion 122 into the depression 346.

In another embodiment, not every portion of the multiple portions of the clasp latch 1010 is independently secured within the first 362 or second 370 recession by a fastening mechanism. Having fastening mechanisms on only some of the portions of the clasp latch 1010 is sufficient to secure all the portions within the first 362 or second 370 recessions when the clasp 1010 is closed. With three sequential portions, for example, only the side portions have fastening mechanisms. The unfastened middle portion is held secure within the first 362 and/or second 370 recession by being constrained between the fastened side portions.

In an additional embodiment, a clasp latch has one or more pivotal connections between a plurality of portions of the clasp latch that align with pivotal connections between the links of the first 356 and second 364 set of links. For the embodiment shown in FIGS. 10 and 11, the pivotal connection 1074 is aligned with the space between the inner ends 358, 366 of the first 356 and second 364 set of links. In the additional embodiment, more or different pivotal connections that connect adjacent portions of the clasp latch align with pivotal connections between adjacent links. In this way, the different portions of the clasp latch can move relative to one another and with the links, giving the wristband 102 greater flexibility.

The fastening mechanism used to secure the clasp legs 324, 336 and the clasp latch 110 in the first 362 and second 370 recessions is not limited to protrusions and depressions that snap together. In alternate embodiments, different fastening mechanisms are used. A fastening mechanism, as used herein, includes any suitable means of fastening or binding the clasp latch 110 to the clasp legs 324, 336 and/or to the sets of links 356, 364 to secure or hold the clasp latch 110 and the clasp legs 324, 336 in the first 362 and second 370 recessions. In one embodiment, for example, the clasp legs 324, 336 and the clasp latch 110 fit tightly into the first 362 and second 370 recessions and are held in place by friction. In another embodiment, the fastening mechanism includes a first part of a ball-detent mechanism coupled to the clasp latch 110. The fastening mechanism further includes a second part of the ball-detent mechanism coupled to the first set of links, wherein the first part of the ball-detent mechanism mates with the second part of the ball detent mechanism when the clasp is closed.

Figure 12:
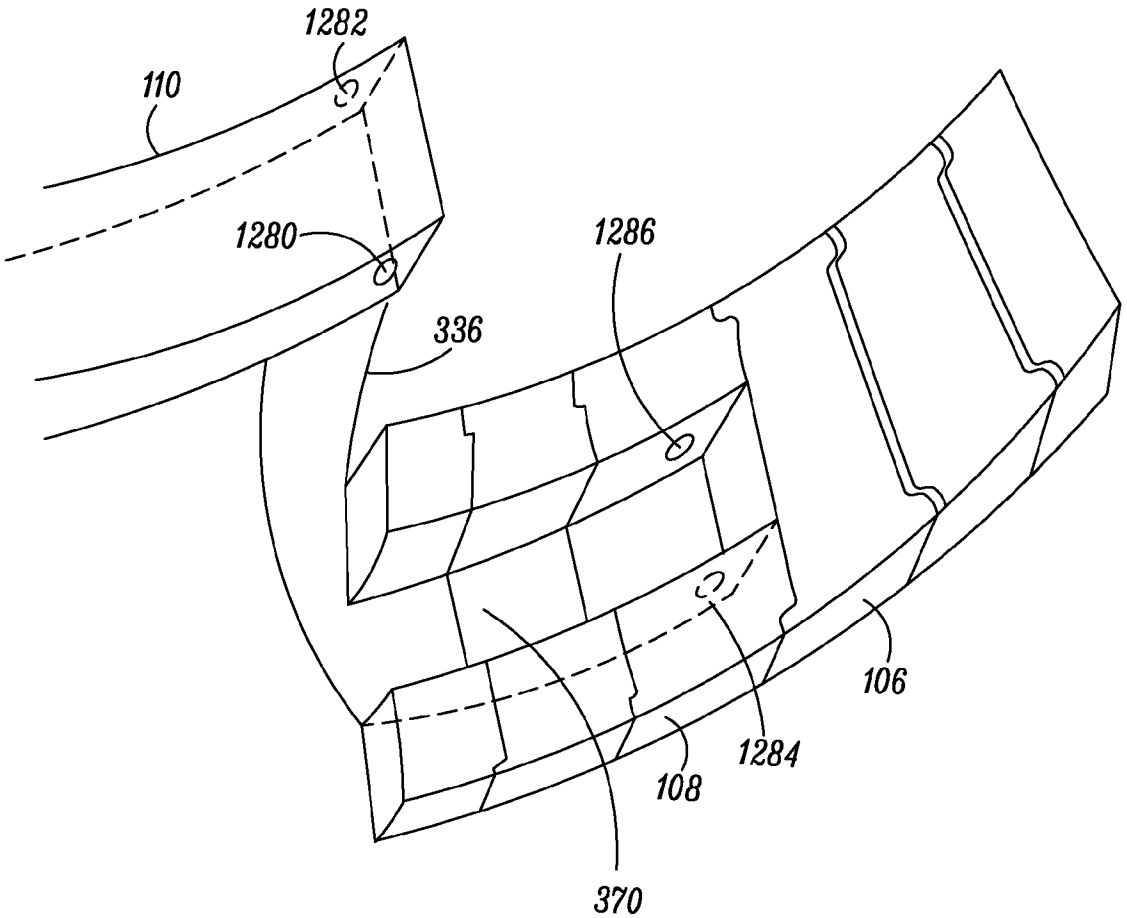
FIG. 12 shows a ball-detent mechanism for fastening a recessed clasp within a wristband in accordance with an embodiment.

FIG. 12 illustrates an embodiment for which a ball-detent mechanism is used to secure the second clasp leg 336 and the second part 374 of the clasp latch 110 into the second recession 370. In particular, FIG. 12 shows: six adjacent links at the inner end 366 of the second set of links 364, the first three links of which have their inner faces recessed to form the second recession 370; the second clasp leg 336; and the second part 374 of the clasp latch 110. On the second part 374 of the clasp latch 110 is a first part 1280 of a first ball-detent mechanism and a first part 1282 of a second ball-detent mechanism. In the second recession 370 at the link 108 is a second part 1284 of the first ball-detent mechanism and a second part 1286 of the second ball-detent mechanism.

When the second part 374 of the clasp latch 110 is pressed into the second recession 370, the first part 1280 of the first ball-detent mechanism mates with the second part 1284 of the first ball-detent mechanism, and the first part 1282 of the second ball-detent mechanism mates with the second part 1286 of the second ball-detent mechanism. In different embodiments, the balls and/or the detents of the ball-detent mechanisms may be on either the second end 374 of the clasp latch 110 or within the second recession 370. The ball-detent mechanisms fasten the second part 374 of the clasp latch 110 within the second recession 370. The second clasp leg 336 is secured within the second recession 370 because it is held underneath the second part 374 of the clasp latch 110. For this embodiment, similar fastening mechanisms would secure the first part 372 of the clasp latch 110 and the first clasp leg 324 within the first recession 362.

For different embodiments, any number of portions of the clasp latch 110 include fastening mechanisms. These fastening mechanisms fasten each of the portions having them to one or more of the first clasp leg 324, the second clasp leg 336, the first set of links 356, or the second set of links 364, thereby securing the clasp latch 110 within the first 362 and second 370 recessions.

Figure 13:
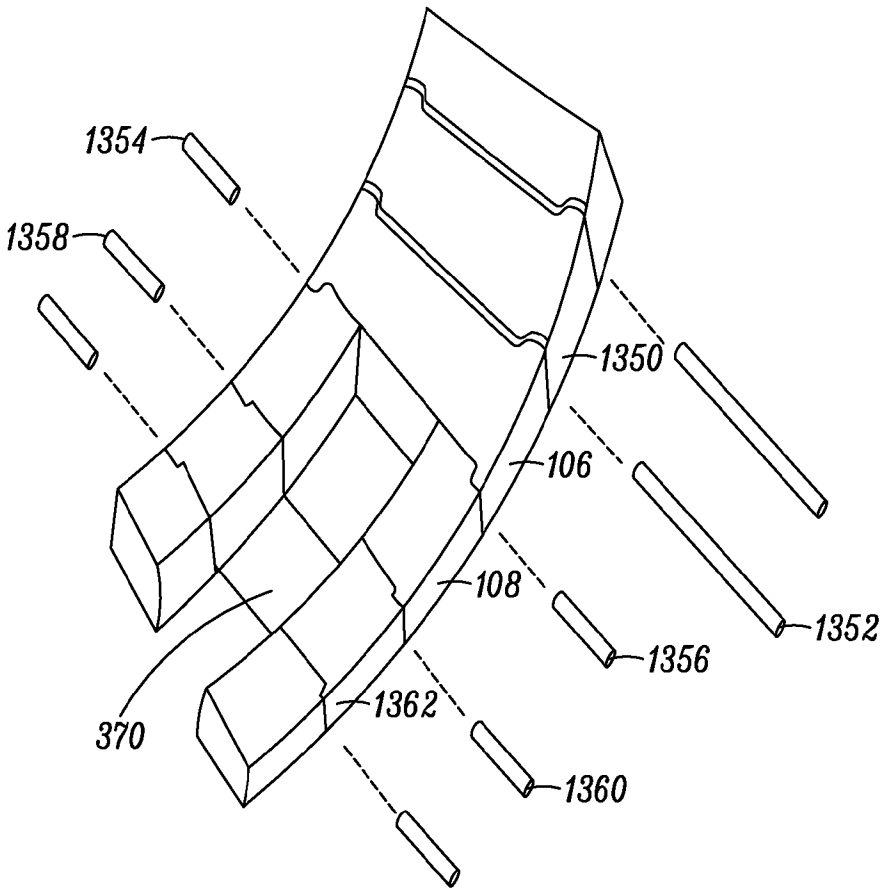
FIG. 13 shows pins used to pivotally connect links of a wristband with a recessed clasp in accordance with an embodiment.

FIG. 13 illustrates how adjacent links of the first 356 and second 364 set of links might be pivotally connected to one another. Specifically, FIG. 13 shows six sequential links from the inner end 366 of the second set of links 364 that, in addition to the links 106 and 108, includes links 1350 and 1362. FIG. 13 also shows multiple pins, including pins 1352, 1354, 1356, 1358, 1360, used to pivotally connect adjacent links to one another. For some embodiments, at least one recessed link of the second set of links 356 having a recessed inside face that forms a portion of a second recession 370 comprises a first pin on a first side of the second recession 370 and a second pin on a second side of the second recession 370, wherein the first pin and the second pin pivotally connect the at least one recessed link to an adjacent link of the second set of links 356.

The link 1350 is not recessed, and a full-length pin 1352 pivotally connects the link 1350 to the adjacent link 106. In one embodiment, the full-length pin 1352 has a length equal to a width of the link 1350. The link 1362 is recessed, and the recession on the inside face of the link 1362 forms part of the second recession 370. The recession in the inside face of the link 1362 does not extend all the way across the link 1362. Portions at both sides of the link 1362, and at both sides of other recessed links, are not recessed. Recessed links, such as link 1362, are not pivotally connected to other recessed links with full-length pins. To do so would block portions of the second recession 370 and interfere with the second clasp leg 336 and the second part 374 of the clasp latch 110 being folded into the second recession 370. Instead, two shorter pins, namely the pins 1358 and 1360, are used to pivotally connect the link 1362 to the link 108.

Each of the shorter pins 1358, 1360 is shorter than the full-length pin 1352. Each of the shorter pins 1358, 1360 is also shorter than or equal to the width of the portion of the link 1362 that is not recessed and into which the pins 1358 and 1360 are inserted. This way, the pins 1358 and 1360 do not extend into the second recession 370 and do not block or otherwise interfere with the second clasp leg 336 and the second part 374 of the clasp latch 110 being folded into the second recession 370. Recessed links of the first set of links 356 that are adjacent to one another are similarly connected using multiple pins that do not block the recessions formed in the inside faces of the links.

Figure 14:
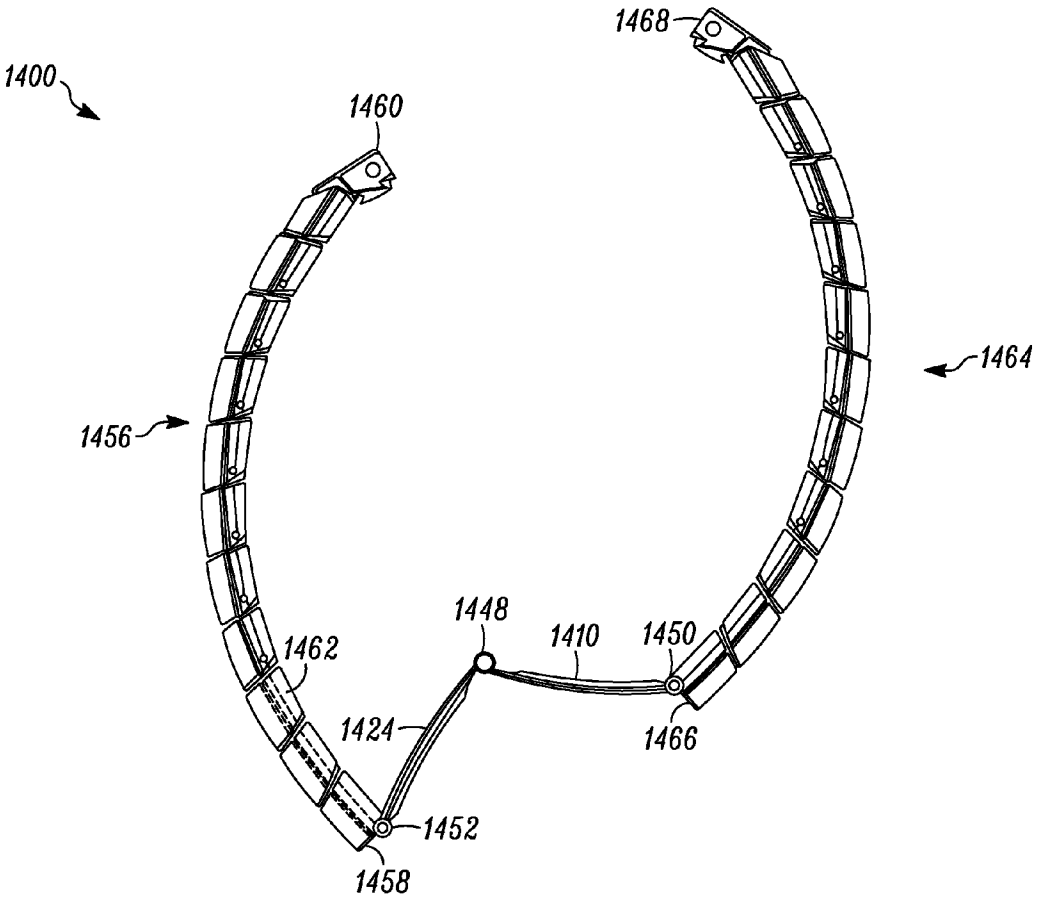
FIG. 14 shows a side view of a wristband with an open clasp in accordance with an embodiment.

While the embodiment of the wristband 102 shown in FIGS. 3 and 4 includes a clasp that has two clasp legs 324, 336, other wristbands consistent with the present teachings may have a different number of clasp legs. FIG. 14 illustrates a wristband 1400 with a single clasp leg. More specifically, FIG. 14 shows the wristband 1400 with a clasp latch 1410, a clasp leg 1424, a first set of links 1456, a second set of links 1464, and three pivotal connections 1448, 1452, 1450.

The clasp leg 1424 and the clasp latch 1410 form a clasp of the wristband 1400. A second end of the clasp latch 1410 is pivotally connected to an inner end 1466 of the second set of links 1464 by the pivotal connection 1450, and a first end of the clasp latch 1410 is pivotally connected to an inner end of the clasp leg 1424 by the pivotal connection 1448. The outer end of the clasp leg 1424 is pivotally connected to an inner end 1458 of the first set of links 1456 by the pivotal connection 1452. The first set of links 1456 includes recessed links with recessions formed on their inside faces. Together, these individual recessions form the recession 1462 into which the clasp leg 1424 and the clasp latch 1410 fold when the clasp of the wristband 1400 is closed. In the closed position, the clasp latch 1410 is folded over the clasp leg 1424 and both are fully recessed into and secured within the recession 1462 by at least one fastening mechanism. For an embodiment, the inner end 1458 of the first set of links 1456 is adjacent to the inner end 1466 of the second set of links 1464 when the clasp is closed.

The first set of links 1456 and the second set of links 1464 also have outer ends at 1460 and 1468, respectively. To these outer ends 1460, 1468, an object can be attached, such as a watch, a portable electronic device, or an ornament. Where a portable electronic device is connected between the outer end 1460 of the first set of links 1456 and the outer end 1468 of the second set of links 1464, the portable electronic device and the wristband 1400 collectively form a wrist-worn electronic device.

One embodiment of the wristband 1400 does not include the second set of links 1464. For this embodiment, the second end of the clasp latch 1410 is pivotally connected to an object that is also attached to the outer end 1460 of the first set of links 1456. For example, an electronic pulse monitoring device is attached to the wristband 1400 between the outer end 1460 of the first set of links 1456 and the pivotal connection 1450.

Figure 15:
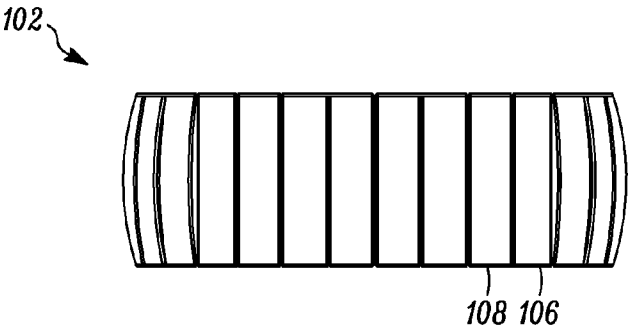
FIG. 15 shows a bottom view of a wristband with a closed clasp in accordance with an embodiment.
Figure 16:
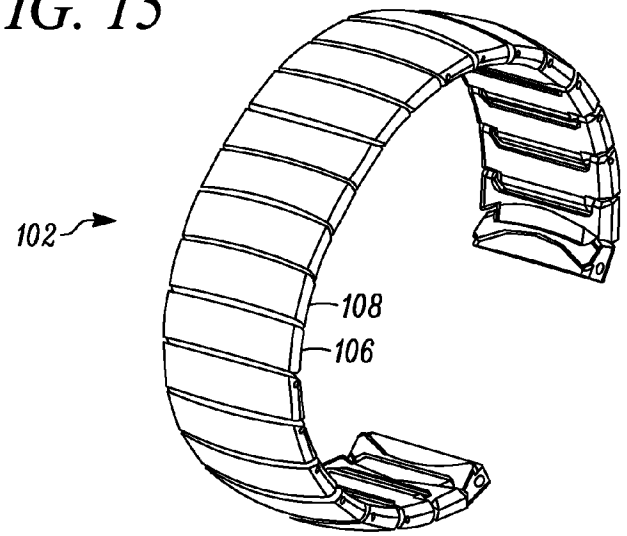
FIG. 16 shows a perspective view of a wristband with a closed clasp in accordance with an embodiment.
Figure 17:
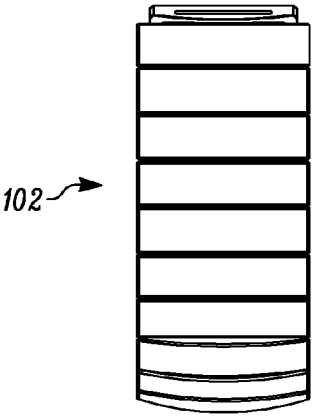
FIG. 17 shows a profile view of a wristband with a closed clasp in accordance with an embodiment.

FIGS. 15, 16, and 17 show a bottom view, a perspective view, and a profile view, respectively, of the wristband 102 with its clasp closed. With the clasp closed and recessed within inside faces of links of the wristband 102, the clasp is not visible when viewed from the outside of the wristband 102. When the wristband 102 is worn upon some wearers' wrists, the clasp of the wristband 102 is not visible at all. Further, because the clasp is recessed within the wristband 102, the clasp does not protrude into the wearer's wrist, allowing for a more-comfortable fit.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A wristband comprising:

a clasp comprising:

a clasp latch having a first end and a second end;

a first clasp leg having an inner end and an outer end, wherein the inner end of the first clasp leg is pivotally connected to the first end of the clasp latch; and a second clasp leg having an inner end and an outer end, wherein the inner end of the second clasp leg is pivotally connected to the second end of the clasp latch;

a first set of links having an inner end pivotally connected to the outer end of the first clasp leg, wherein an inside face of at least one link of the first set of links is recessed to form a first recession that is shaped to cradle the first clasp leg and a first part of the clasp latch when the clasp is closed; and a second set of links having an inner end pivotally connected to the outer end of the second clasp leg, wherein an inside face of at least one link of the second set of links is recessed to form a second recession that is shaped to cradle the second clasp leg and a second part of the clasp latch when the clasp is closed, wherein when the clasp is closed, an inside face of the clasp latch is flush with or below inside faces of non-recessed links of the first and second set of links.

2. The wristband of claim 1, wherein when the clasp is closed, the first clasp leg is folded into the first recession underneath the first part of the clasp latch, and the second clasp leg is folded into the second recession underneath the second part of the clasp latch.

3. The wristband of claim 1, wherein the clasp latch has a combined length of the first and second clasp legs.

4. The wristband of claim 1, wherein when the clasp is closed, the inner end of the first set of links is adjacent to the inner end of the second set of links.

5. The wristband of claim 1 further comprising a fastening mechanism configured to secure the first part of the clasp latch within the first recession over the first clasp leg and to secure the second part of the clasp latch within the second recession over the second clasp leg, when the clasp is closed.

6. The wristband of claim 5, wherein the fastening mechanism comprises:

a first protrusion and a second protrusion formed in an outside face of the clasp latch;

a first depression formed in an inside face of the first clasp leg that mates with the first protrusion when the clasp is closed; and a second depression formed in an inside face of the second clasp leg that mates with the second protrusion when the clasp is closed.

7. The wristband of claim 5, wherein the fastening mechanism comprises:

a first part of a ball-detent mechanism coupled to the clasp latch; and a second part of the ball-detent mechanism coupled to the first set of links, wherein the first part of the ball-detent mechanism mates with the second part of the ball detent mechanism when the clasp is closed.

8. The wristband of claim 1, wherein the at least one link of the first set of links comprises a first pin on a first side of the first recession and a second pin on a second side of the first recession, wherein the first pin and the second pin pivotally connect the at least one link of the first set of links to an adjacent link of the first set of links.

9. The wristband of claim 1, wherein:

an inside face of the first clasp leg, an inside face of the second clasp leg, and an inside face of the clasp latch have concave curvature; and an outside face of the first clasp leg, an outside face of the second clasp leg, and an outside face of the clasp latch have convex curvature.

10. The wristband of claim 1, wherein the first part of the clasp latch is pivotally connected to the second part of the clasp latch.

11. The wristband of claim 10, wherein when the clasp is closed, a pivotal connection between the first and second parts of the clasp latch aligns between the inner end of the first set of links and the inner end of the second set of links.

12. The wristband of claim 10, wherein when the clasp is closed, one or more pivotal connections between the parts of the clasp latch align with pivotal connections between the links of the first and second set of links.

13. The wristband of claim 10, wherein each part of the clasp latch comprises a fastening mechanism configured to fasten the respective part of the clasp latch to at least one of:

the first clasp leg;

the second clasp leg;

the first set of links; or the second set of links.

14. A method of operating a wristband, the method comprising:

rotating a first clasp leg about a first pivotal connection between the first clasp leg and a first set of links and rotating a first part of a clasp latch about a second pivotal connection between the first part of the clasp latch and the first clasp leg until the first part of the clasp latch and the first clasp leg are folded into a first recession formed in an inside face of at least one link of the first set of links; and rotating a second clasp leg about a third pivotal connection between the second clasp leg and a second set of links and rotating a second part of the clasp latch about a fourth pivotal connection between the second part of the clasp latch and the second clasp leg until the second part of the clasp latch and the second clasp leg are folded into a second recession formed in an inside face of at least one link of the second set of links, wherein when the clasp is closed, an inside face of the clasp latch is flush with or below inside faces of non-recessed links of the first and second set of links.

15. The method of claim 14 further comprising:

securing the first part of the clasp latch and the first clasp leg into the first recession; and securing the second part of the clasp latch and the second clasp leg into the second recession.

16. The method of claim 15, wherein securing the first part of the clasp latch and the first clasp leg into the first recession comprises at least one of:

mating a first part of a snap mechanism on the first part of the clasp latch with a second part of the snap mechanism on the first clasp leg; or mating a first part of a ball-detent mechanism on the first part of the clasp latch with a second part of the ball-detent mechanism on the first set of links.

17. A wristband comprising:

a clasp comprising:

a clasp latch having a first end and a second end;

a first clasp leg having an inner end and an outer end, wherein the inner end of the first clasp leg is pivotally connected to the first end of the clasp latch; and a second clasp leg having an inner end and an outer end, wherein the inner end of the second clasp leg is pivotally connected to the second end of the clasp latch;

a first set of links having an inner end pivotally connected to the outer end of the first clasp leg, wherein an inside face of at least one link of the first set of links is recessed to form a first recession that is shaped to cradle the first clasp leg and a first part of the clasp latch when the clasp is closed;

a second set of links having an inner end pivotally connected to the outer end of the second clasp leg, wherein an inside face of at least one link of the second set of links is recessed to form a second recession that is shaped to cradle the second clasp leg and a second part of the clasp latch when the clasp is closed; and a fastening mechanism configured to secure the first part of the clasp latch within the first recession over the first clasp leg and to secure the second part of the clasp latch within the second recession over the second clasp leg, when the clasp is closed, wherein the fastening mechanism comprises:

a first protrusion and a second protrusion formed in an outside face of the clasp latch;

a first depression formed in an inside face of the first clasp leg that mates with the first protrusion when the clasp is closed; and a second depression formed in an inside face of the second clasp leg that mates with the second protrusion when the clasp is closed.

18. A wristband comprising:

a clasp comprising:

a clasp latch having a first end and a second end;

a first clasp leg having an inner end and an outer end, wherein the inner end of the first clasp leg is pivotally connected to the first end of the clasp latch; and a second clasp leg having an inner end and an outer end, wherein the inner end of the second clasp leg is pivotally connected to the second end of the clasp latch;

a first set of links having an inner end pivotally connected to the outer end of the first clasp leg, wherein an inside face of at least one link of the first set of links is recessed to form a first recession that is shaped to cradle the first clasp leg and a first part of the clasp latch when the clasp is closed; and a second set of links having an inner end pivotally connected to the outer end of the second clasp leg, wherein an inside face of at least one link of the second set of links is recessed to form a second recession that is shaped to cradle the second clasp leg and a second part of the clasp latch when the clasp is closed, wherein the at least one link of the first set of links comprises a first pin on a first side of the first recession and a second pin on a second side of the first recession, wherein the first pin and the second pin pivotally connect the at least one link of the first set of links to an adjacent link of the first set of links.

19. A method of operating a wristband, the method comprising:

rotating a first clasp leg about a first pivotal connection between the first clasp leg and a first set of links and rotating a first part of a clasp latch about a second pivotal connection between the first part of the clasp latch and the first clasp leg until the first part of the clasp latch and the first clasp leg are folded into a first recession formed in an inside face of at least one link of the first set of links;

rotating a second clasp leg about a third pivotal connection between the second clasp leg and a second set of links and rotating a second part of the clasp latch about a fourth pivotal connection between the second part of the clasp latch and the second clasp leg until the second part of the clasp latch and the second clasp leg are folded into a second recession formed in an inside face of at least one link of the second set of links;

securing the first part of the clasp latch and the first clasp leg into the first recession; and securing the second part of the clasp latch and the second clasp leg into the second recession, wherein securing the first part of the clasp latch and the first clasp leg into the first recession comprises at least one of:

mating a first part of a snap mechanism on the first part of the clasp latch with a second part of the snap mechanism on the first clasp leg; or mating a first part of a ball-detent mechanism on the first part of the clasp latch with a second part of the ball-detent mechanism on the first set of links.

* * * * *